US005246220A

United States Patent [19]

Suya

[11] Patent Number: 5,246,220

[45] Date of Patent: Sep. 21, 1993

[54] SHEET FEEDING DEVICE

[75] Inventor: Toshihiro Suya, Minamiashigara, Japan

[73] Assignee: Fuji Photo Film Co., Ltd., Kanagawa, Japan

[21] Appl. No.: 805,945

[22] Filed: Dec. 12, 1991

[30] Foreign Application Priority Data

Dec. 14, 1990 [JP] Japan ..... 2-402476
Dec. 14, 1990 [JP] Japan ..... 2-402477
Dec. 14, 1990 [JP] Japan ..... 2-402478

[51] Int. Cl.[5] ..... B65H 3/48
[52] U.S. Cl. ..... 271/105; 271/98
[58] Field of Search ..... 271/98, 104, 105, 121, 271/167

[56] References Cited

U.S. PATENT DOCUMENTS 1,867,038 7/1932 Upham ..... 271/105
2,848,227 8/1958 Gulick ..... 271/98
3,083,011 3/1963 Saul ..... 271/105
3,627,308 12/1971 Stoever .
3,690,644 9/1972 Halbert ..... 271/98
3,865,364 2/1975 Sterner ..... 271/105
4,548,395 10/1985 Snellman et al. ..... 271/105
4,579,330 4/1986 Lehmann ..... 271/98
4,854,569 8/1989 Mizuta .
4,886,261 12/1989 Jeschke ..... 271/105
5,050,853 9/1991 LaVos et al. ..... 271/98
5,110,110 5/1992 Wirz et al. ..... 271/105

FOREIGN PATENT DOCUMENTS 771617 7/1934 France ..... 271/105
57-1140 1/1982 Japan .
64-22745 1/1989 Japan .
4116647 4/1992 Japan .

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

Disclosed herein is a device for feeding sheets, one by one, from a stack of sheets stored in a sheet placement unit. The sheet feeding device basically comprises suction cups or pads facing one end of the edge of an uppermost sheet of the stacked sheets, for taking out the uppermost sheet, an engaging member located at the sheet placement unit, for supporting the leading ends in the withdrawal direction of the stacked sheets, and a roller disposed near the engaging member and positioned to face a cut-away portion in a portion of the engaging member facing the opposite end of the uppermost sheet, the opposite end being spaced away from the suction pads. The cut-away portion is formed to prevent the opposite end of the uppermost sheet from contacting with the engaging member due to hang down of the uppermost sheet. In addition, the cut-away portion is inclined downwards toward the opposite end of the uppermost sheet from the one end thereof. The engaging member has a recess portion formed in a portion facing the opposite end of the uppermost sheet along the direction of the thickness of the engaging member in order to form a space between the uppermost sheet and the engaging member.

3 Claims, 9 Drawing Sheets

SHEET FEEDING DEVICE

BACKGROUND OF THE INVENTION

1. Field of the Invention

The present invention relates to a device for reliably feeding sheets, one by one, from a stack of sheets to an automatic photographic processor or the like. Description of the Related Art:

A sheet feeding device has been used to deliver sheets such as unexposed photographic light-sensitive mediums, one by one, from either a supply magazine or a sheet placement table in which the sheets have been stored in a stacked state. The sheets are delivered to an exposure station and after the sheets have been exposed, are fed one by one to a developing machine.

The sheet feeding device is so constructed that a plurality of suction cups or pads (sheet separating means) are positioned to face a sheet stack. The suction pads are pressed against an uppermost sheet of the stacked sheets to hold and remove the uppermost sheet under a suction generated by a vacuum generator.

Different sized sheets such as photographic films are employed for various uses. Such different sized sheets are fed one by one by use of a single sheet feeding device. In this sheet feeding device, one or more suction pads are disposed to face one end of an edge of the uppermost sheet of the sheets so as to meet the smallest sized sheet of the different sized sheets to avoid air leakage that would result when the smallest sized sheet is attracted. Therefore, when a sheet of particularly a large size is employed, the opposite end of the sheet with regard to the suction pads is spaced a long distance away from the suction pads, which results in the sheet hanging due to its own weight or stiffness.

Thus, the opposite end of the sheet is brought into contact with an engaging member which holds the stacked sheets on a sheet placement table, thereby creating a failure during sheet feeding or damage to the sheets.

In order to avoid the hanging of the opposite end of the sheet with regard to the suction pads when the uppermost sheet is attracted under suction by the suction pads, the following approaches have heretofore been made. Specifically, a sheet placement table or portion is formed in such a shape that the portion can upwardly tilt the opposite end of the sheet which may hang down. Alternatively, there is located at least one auxiliary suction pad opposing the opposite end of the sheet which may hang down. When sheets of, for example, large size are fed one by one, the auxiliary suction pad is driven to hold the opposite end of the sheet under suction.

In the conventional sheet feeding device, however, a process for loading a plurality of sheets in the sheet placement portion having shape referred to the above is greatly cumbersome, thereby causing the problem that the sheet feeding process as a whole cannot efficiently be carried out.

When the auxiliary suction pad referred to above is provided, the pad must be activated only when the sheets of large size are fed one by one, thereby causing the problem that control of the auxiliary suction pad is complicated and hence its operation efficiency becomes inferior.

In addition to the above problems there is often a situation in which the stacked sheets adhere firmly to one another. It is therefore necessary to reliably separate only the uppermost sheet from the adjacent lower sheets by suction cups or pads so as to remove the uppermost sheet from the sheet placement portion. To this end, there have heretofore been proposed various approaches. In general, the uppermost sheet attracted by the suction pads is moved along complicated loci or paths to have the sheet turned or swung, thereby preventing a plurality of sheets from being fed simultaneously.

In the conventional sheet feeding device referred to above, however, an extremely complex mechanism is required for turning or swinging the uppermost sheet. Thus, the entire construction of the sheet feeding device becomes complex and the manufacturing cost is rendered high.

There is also a case in which the lower sheets underneath the uppermost sheet are successfully are separated from the uppermost sheet attracted performing the suction pads by sheet turning or swinging action. In this case, however, the lower sheets are held in the sheet successfully removed at times cannot reliably be returned into a sheet placement portion. Therefore, a pressing bar must normally be used, so that the sheet feeding process cannot efficiently be carried out.

SUMMARY OF THE INVENTION

It is a principal object of the present invention to provide a sheet feeding device of a type wherein stacked sheets can reliably be taken out one by one with a simple structure and the entire sheet feeding process can efficiently be carried out.

It is another object of the present invention to provide a device for feeding sheets one by one, the device comprising sheet separating means facing one end of an edge of an uppermost sheet of stacked sheets, for taking out the uppermost sheet, and engaging means disposed in a sheet placement portion, for supporting the leading ends in the withdrawal direction of the stacked sheets, the engaging means including a cut-away portion corresponding to the opposite end of the uppermost sheet being spaced away from the sheet separating means, to prevent the opposite end of the uppermost sheet from contacting with the engaging means due to a hang down of the uppermost sheet.

It is a further object of the present invention to provide a device wherein the cut-away portion slopes down toward the opposite end of the uppermost sheet with regard to the sheet separating means from the one end of the sheet.

It is still a further object of the present invention to provide a device further including sheet position correcting means which is located near the engaging means and also faces at least the cut-away portion.

It is still a further object of the present invention to provide a device wherein the sheet position correcting means comprises a rotatable roller.

It is still a further object of the present invention to provide a device wherein the engaging means includes a cut-away portion formed at the opposite end of the uppermost sheet with respect to the sheet separating means along the direction of the thickness of the engaging means so as to form a space between the uppermost sheet and the engaging means.

It is still a further object of the present invention to provide a device for feeding sheets one by one, the device comprising sheet separating means for taking out an uppermost one of stacked sheets, and engaging means disposed at a sheet placement portion for supporting the leading ends in the withdrawal direction of the stacked sheets on the portion, the engaging means having at least one air inlet port for introducing air into a space between the uppermost sheet and the next sheet when the uppermost sheet is taken out from the stacked sheets to enable the next sheet to be separated from the uppermost sheet.

It is still a further object of the present invention to provide a device wherein said at least one air inlet port comprises either a groove or a hole.

It is still a further object of the present invention to provide a device wherein said at least one air inlet port comprises a groove and a hole.

It is still a further object of the present invention to provide a device wherein the engaging means includes a cut-away portion corresponding to an end of the side edge of the uppermost sheet, the end being spaced away from the sheet separating means, the cut-away portion being defined to prevent the end of the side edge of the sheet from contacting with the engaging means due to hang down of the uppermost sheet.

It is still a further object of the present invention to provide a device for feeding sheets one by one, the device comprising sheet separating means for taking out an uppermost one of stacked sheets, and engaging means located at a sheet placement portion, for supporting the leading ends in the withdrawal direction of the stacked sheets thereon, the engaging means being disposed in such a way as to be tilted by a given angle toward the side edge of the stacked sheets from the direction perpendicular to the surfaces of the stacked sheets.

It is still a further object of the present invention to provide a device wherein the engaging means includes a cut-away portion corresponding to an end of the side edge of the uppermost sheet being spaced away from the sheet separating means, the cut-away portion being defined to prevent the end of the side edge of the sheet from contacting with the engaging means due to a hang down of the uppermost sheet.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 1:
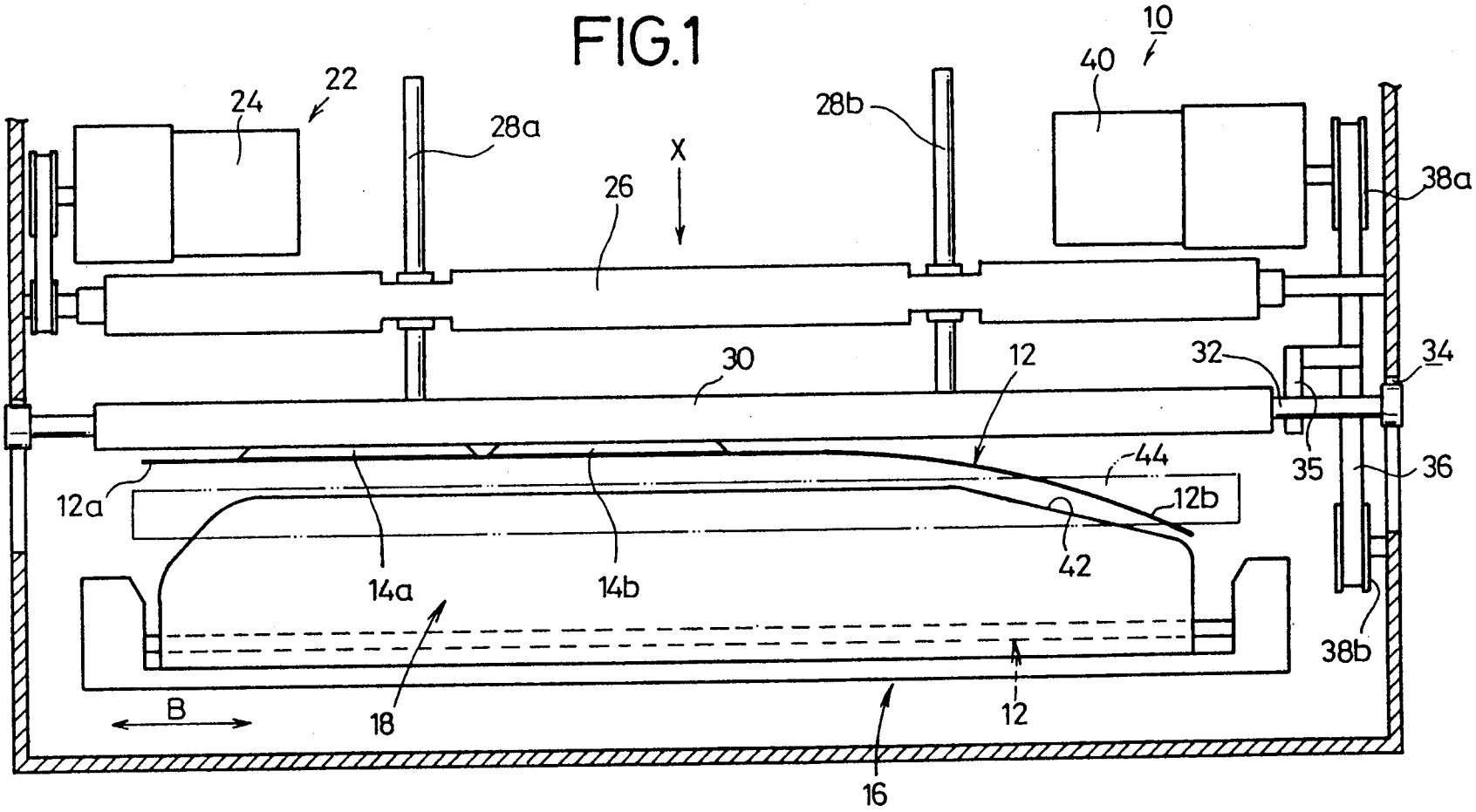
FIG. 1 is a view schematically showing the structure of an essential part of a sheet feeding device according to a first embodiment of the present invention.
Figure 2:
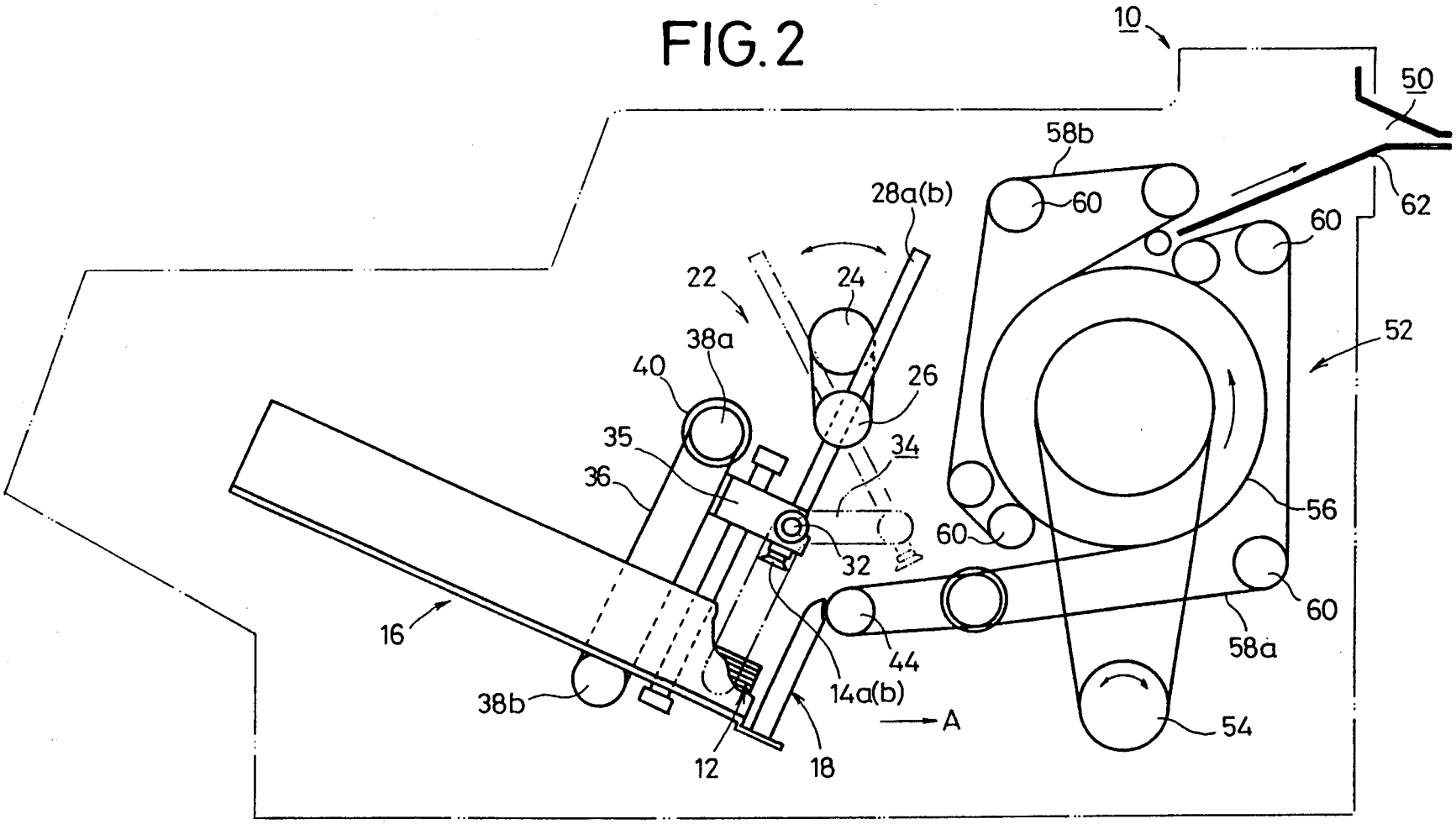
FIG. 2 is a view schematically illustrating the structure of the sheet feeding device.

Referring to FIGS. 1 and 2, numeral 10 indicates a sheet feeding device according to a first embodiment of the present invention. If suction pads were located along the entire side edge of the stacked sheets 12, a vacuum may be broken due to air leakage that would result when a small sized sheet is attracted. Accordingly, the sheet feeding device 10 comprises suction cups or pads (sheet separating means) **14*a*, 14*b* located so as to face one end 12*a* of the side edge of an uppermost photographic light-sensitive medium 12 in order to remove the uppermost photographic light-sensitive medium 12 from the stack of photographic light-sensitive mediums (sheets) 12. Also provided is an engaging member 18 located at a sheet placement portion on unit 16, for supporting the leading end in the withdrawal direction of the stacked photographic light-sensitive mediums 12 (corresponding to the direction indicated by the arrow A in FIG. 2**).

The suction pads **14*a*, 14*b* are displaceable in unison with each other by a drive means 22. The drive means 22 has a rotative drive source 24, a rotatable shaft 26 which is coupled to the rotative drive source 24 and guide bars 28*a*, 28*b* which are slidably inserted into the shaft 26. A holder 30 is fixedly mounted on the guide bars 28*a*, 28*b*, and both ends of a rod 32 fixed to the holder 30 are inserted into substantially L-shaped guide grooves 34. A movable member 35 is brought into engagement with one end of the rod 32. The movable member 35 is fixedly mounted on a belt 36, which is wound between a pair of pulleys 38*a*, 38*b*, wherein the pulley 38*a* is coupled to a rotative drive source 40**.

The suction pads **14*a*, 14*b* are mounted on the holder 30. The suction pads 14*a*, 14*b* are substantially in elongated rectangular paralelopiped form which extends in the direction (i.e., in the direction indicated by the arrow B in FIG. 1) normal to the withdrawal direction (i.e., the direction indicated by the arrow A) of an uppermost one of stacked sheets 12. The suction pads 14*a*, 14*b*** communicate with an unillustrated vacuum valve.

The engaging member 18 is an elongated plate-like member extending in the direction indicated by the arrow B, and has a cut-away portion 42 formed at a portion corresponding to the opposite end **12*b* of the uppermost photographic light-sensitive medium 12, with respect to the suction pads 14*a*, 14*b*. The cut-away portion 42 is defined to prevent the opposite end 12*b* of the sheet from being brought into contact with the engaging member 18 due to the hang down of the photographic light-sensitive medium 12. Specifically, the cut-away portion 42 is formed to incline downwardly toward the opposite end 12*b* with respect to the one end 12*a* of the photographic light-sensitive medium 12** as seen in the direction indicated by the arrow B.

A roller 44, serving as a sheet position or posture correcting means, which has a width corresponding to the maximum width of the photographic light sensitive medium 12 extending in the direction indicated by the arrow B, is rotatably disposed near the engaging member 18.

As shown in FIG. 2, a delivery mechanism 52 is disposed in the sheet feeding device 10 for delivering an uppermost photographic light-sensitive medium 12 taken from the sheet placement unit 16 to an outlet 50.

The delivery mechanism 52 has a large-diameter drum 56 rotated by a rotative drive source 54. The drum 56 has an outer peripheral surface which contacts a first belt 58*a* and a second belt 58*b*, which are wound around a plurality of rollers 60. A guide plate 62 is disposed near the outlet 50, and the uppermost photographic light-sensitive medium 12 is guided by the plate 62 and transported from the outlet 50 to an unillustrated automatic photographic processor or the like.

The operation of the sheet feeding device constructed as described above will now be described below.

When a plurality of stacked photographic light-sensitive mediums 12 are loaded in the sheet placement unit 16 in the sheet feeding device 10, the photographic light-sensitive mediums 12 slide on the bottom plate of the sheet placement unit 16, and the leading ends of the stacked light-sensitive mediums 12 are brought into abutment against the engaging member 18 to be supported by the engaging member 18.

The rotative drive source 40 of the drive means 22 is energized to cause the pulleys 38*a*, 38*b* and the belt 36 to displace the rod 32 toward the uppermost photographic light-sensitive medium 12 along the guide grooves 34. Then, the suction pads 14*a*, 14*b* start to suck an uppermost photographic light-sensitive medium 12 at a predetermined position, and attract and hold the uppermost photographic light-sensitive medium 12 under suction.

Then, the rotative drive source 40 is reversed to elevate the rod 32 along the guide grooves 34, such that the uppermost photographic light-sensitive medium 12 which has been attracted and held by the suction pads 14*a*, 14*b* is separated from a photographic light-sensitive medium below the uppermost light-sensitive medium 12 and only the uppermost photographic light-sensitive medium 12 is removed from the stacked photographic light-sensitive medium 12. When the rod 32 reaches the corner of the guide grooves 34, the rotative drive source 40 is de-energized, and the rotative drive source 24 is energized to rotate the rotatable shaft 26, and the rod 32 is turned in a given angular range (see the two-dot chain line in FIG. 2). As a consequence, the uppermost photographic light-sensitive medium 12 which has been attracted and held by the suction pads 14*a*, 14*b* is delivered to the delivery mechanism 52.

When the suction pads 14*a*, 14*b* are inactivated, the uppermost photographic light-sensitive medium 12 is released. The rotative drive source 54 of the delivery mechanism 52 is energized to rotate the drum 56 in the direction indicated by the arrow, and the uppermost photographic light-sensitive medium 12 is transported to a given angular position by means of the drum 56, the first belt 58*a* and the second belt 58*b*. Then, the rotative drive source 54 is energized to rotate the drum 56 in the direction opposite to the direction indicated by the arrow, and the photographic light-sensitive medium 12 supported on the drum 56 is delivered from the outlet 50 to an automatic photographic processor or the like guided by the guide plate 62.

The suction pads 14*a*, 14*b* are located so as to face the one end 12*a* of the leading end of the uppermost photographic light-sensitive medium 12. Therefore, when a photographic light-sensitive medium 12 of particularly a large size, is used (see FIG. 1), the opposite end 12*b* of the photographic light-sensitive medium 12 is spaced away from the suction pads 14*a*, 14*b*. Therefore, the opposite end 12*b* of the photographic light-sensitive medium 12 tends to sag or hang down due to its own weight or stiffness when the large-sized photographic light-sensitive medium 12 is attracted and held by the suction pads 14*a*, 14*b*.

In the present embodiment, the cut-away portion 42 on the engaging member 18 is designed to form a slant face to meet the degree of hang down of the opposite end 12*b* of the photographic light-sensitive medium 12. Thus, even if the opposite end 12*b* of the photographic light-sensitive medium 12 hangs down as shown in FIG. 1, the opposite end 12*b* can reliably be prevented from being brought into contact with the engaging member 18, so that photographic light-sensitive mediums 12 of different size can efficiently and reliably be separated and fed one by one to a desired station.

It is also possible to avoid a cumbersome process when photographic light-sensitive mediums 12 are loaded on a slant sheet placement portion. Further, it is possible to avoid difficulties in operation or, complexity of control when auxiliary suction pads are used to attract only a large-sized photographic light-sensitive medium 12.

Figure 3:
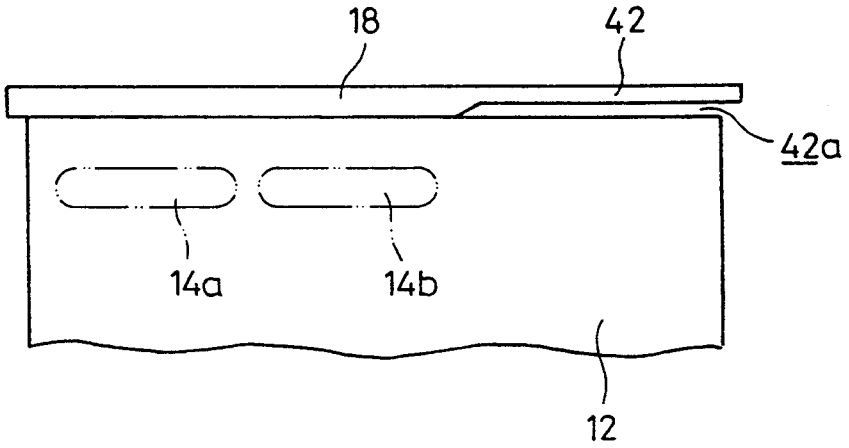
FIG. 3 is a plan view as seen in the direction indicated by arrow X of FIG. 1.

As shown in FIG. 3, it is desirable that a recess portion 42*a* be formed in a direction of the thickness of the engaging member 18 at an end opposite to the suction pads 14*a*, 14*b*. Thus, when the suction pads 14*a*, 14*b* attract and hold the uppermost photographic light-sensitive medium 12 and lifts the same upwardly, the elevation of the uppermost photographic light-sensitive medium 12 is not prevented due to the photographic light-sensitive medium 12 contacting the inner wall surface of the engaging member 18. The recess portion 42*a* may be formed at a position spaced away from the suction pads 14*a*, 14*b*. The depth of the recess portion 42*a*, for example, is about 4 mm, in the direction of the thickness of the engaging member 18 (the thickness of the engaging member 18 is about 10 mm).

After the large-sized photographic light-sensitive medium 12 referred to above is attracted by the suction pads 14*a*, 14*b* and taken out from the sheet placement unit 16, the position or posture of the opposite end 12*b* which is not sucked by the suction pads 14*a*, 14*b* and is hanging down, is corrected by the roller 44 to enable the light-sensitive medium 12 to reliably feed toward the delivery mechanism 52.

In the present embodiment, the photographic light-sensitive medium 12 on which images have been exposed are fed to the automatic photographic processor. However, the present embodiment can also be applied to an example where unexposed photographic light-sensitive mediums 12 are fed one by one to an image recording device.

A sheet feeding device according to a second embodiment of the present invention will now be described below in detail with reference to the accompanying drawings. The same elements and structure as employed in the sheet feeding device according to the first embodiment are denoted by the same reference numerals, and their detailed description will therefore be omitted.

Figure 4:
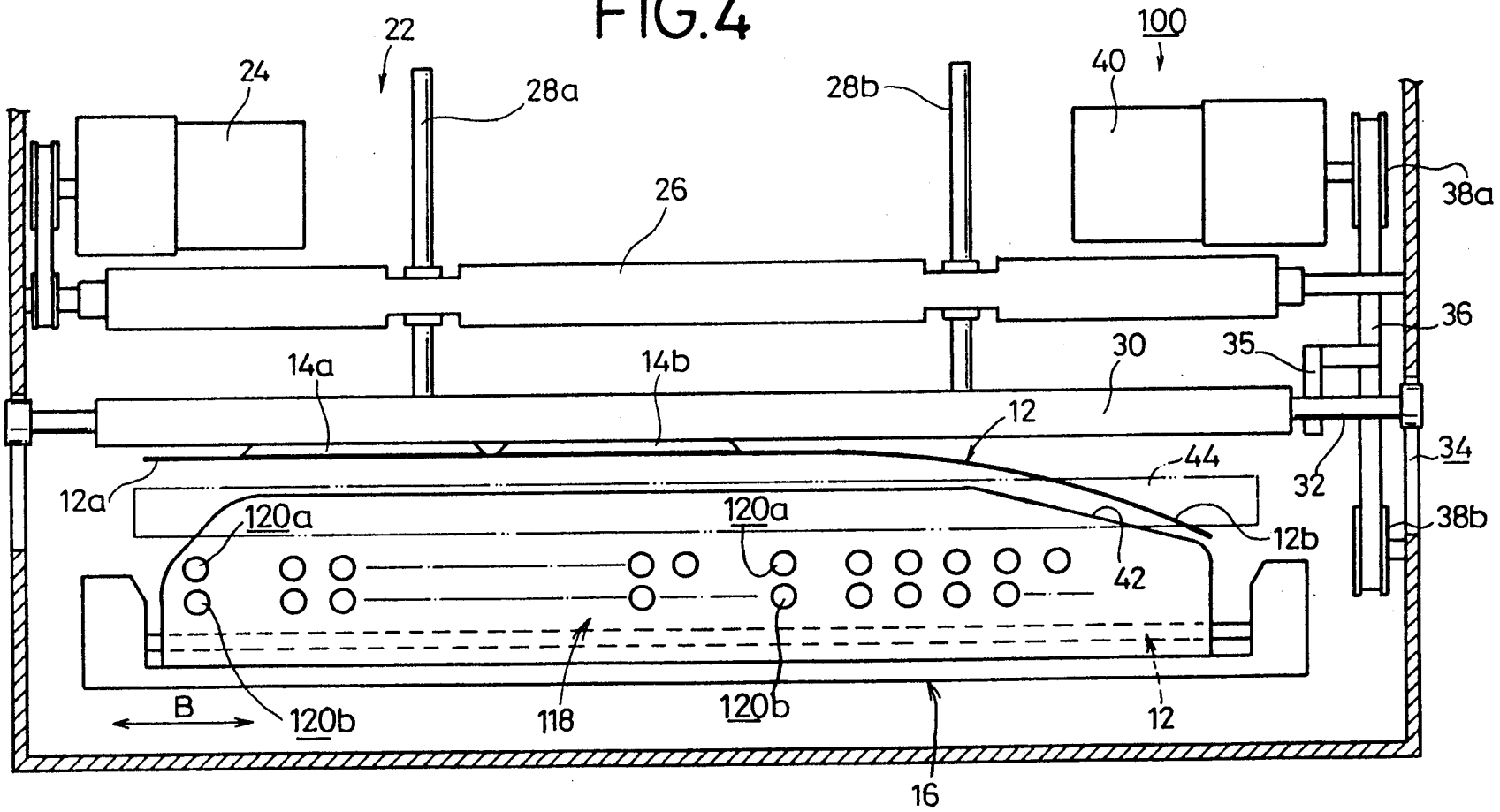
FIG. 4 is a view schematically depicting the structure of an essential part of a sheet feeding device according to a second embodiment of the present invention.
Figure 5:
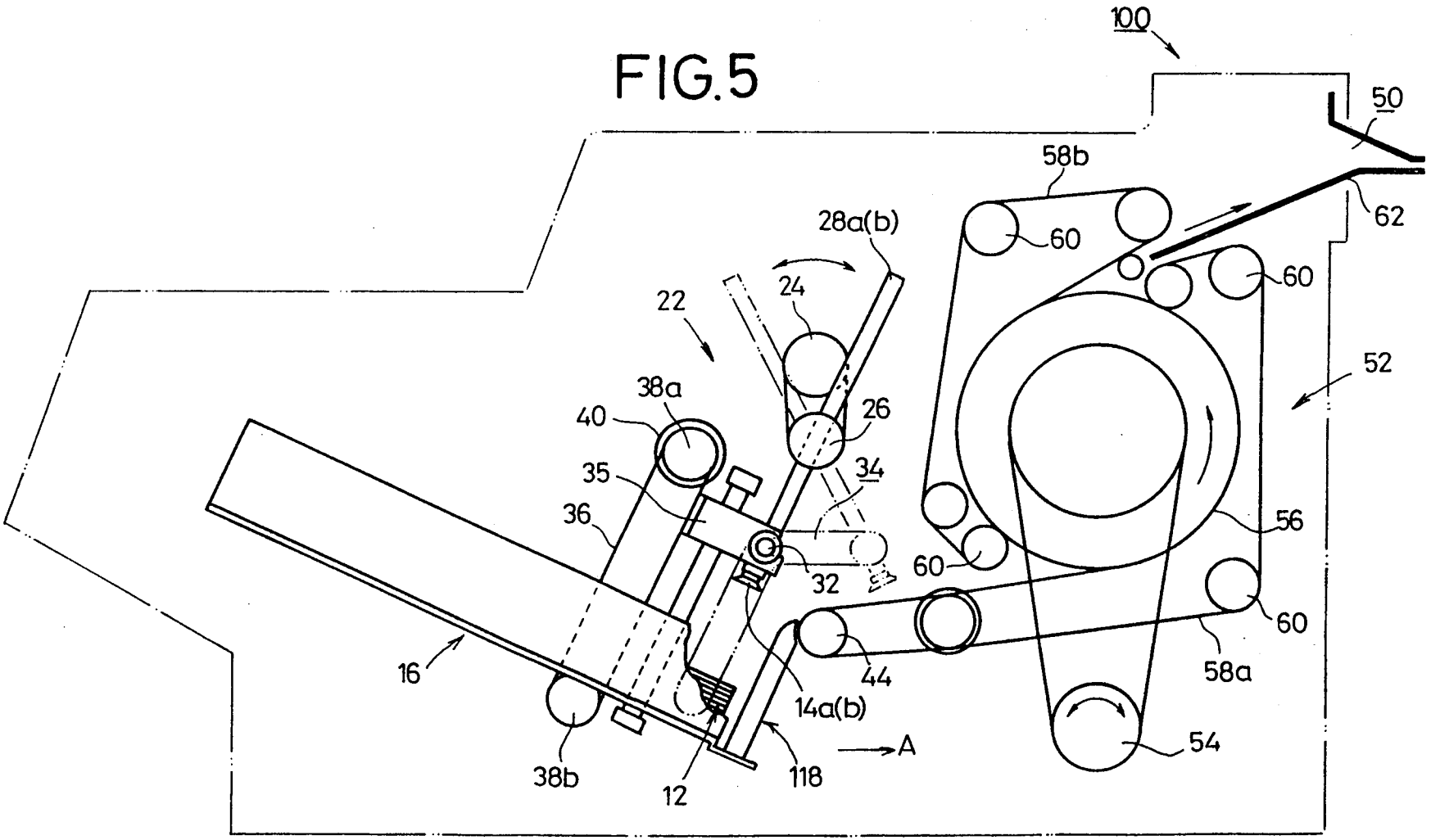
FIG. 5 is a view schematically showing the structure of the sheet feeding device shown in FIG. 4.
Figure 6:
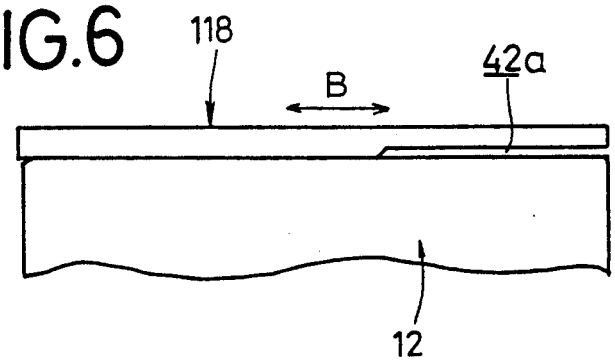
FIG. 6 is a fragmentary plan view illustrating the sheet feeding device shown in FIG. 4.

Referring to FIGS. 4 and 5, numeral 100 denotes the sheet feeding device according to the second embodiment. An engaging member 118 of the sheet feeding device 100 is an elongated plate-like member extending in the direction indicated by the arrow B. As shown in FIG. 6, the engaging member 118 has a recess portion 42*a* formed at a position opposite to suction pads 14*a*, 14*b* in order to form a given space between the leading end of the uppermost photographic light-sensitive medium 12 and the engaging member 118. It is thus possible to avoid any failure in sheet feeding operation, due to the contact of the leading end of the photographic light-sensitive medium 12 with the engaging member 118 when the suction pads 14*a*, 14*b* attract and hold a large-sized photographic light-sensitive medium 12 and lifts the same upwardly. More specifically, for example, the thickness of the engaging member 118 is about 10 mm, and the depth of the recess portion 42*a* is about 4 mm. Further, the engaging member 118 has a cut-away portion 42 formed at a portion corresponding to the opposite end 12*b* to the suction pads 14*a*, 14*b* of the uppermost photographic light-sensitive medium 12, where the opposite end 12*b* is spaced away from the suction pads 14*a*, 14*b*, so that the cut-away portion 42 can prevent the leading end of the photographic light-sensitive medium 12 from contacting the engaging member 118 due to the hang down of the photographic light-sensitive medium 12 (see FIG. 4).

The engaging member 118 has holes (air inlet ports) 120*a*, 120*b* along the longitudinal direction of the engaging member 118 (i.e., along the direction indicated by the arrow B) in a plurality of rows. In the embodiment, a pair of the holes 120*a*, 120*b* are formed in upper and lower position, but, the number of the holes can be changed as needed.

The operation of the sheet feeding device 100 as described above will now be described. The operation common to that of the aforementioned sheet feeding device 10 will not be described.

When a plurality of photographic light-sensitive mediums 12 are first loaded in the sheet placement unit 16, the uppermost photographic light-sensitive medium 12 is attracted under suction by the suction pads 14*a*, 14*b* of a drive means 22 so as to upwardly remove the sheet from the sheet placement unit 16.

Figure 7:
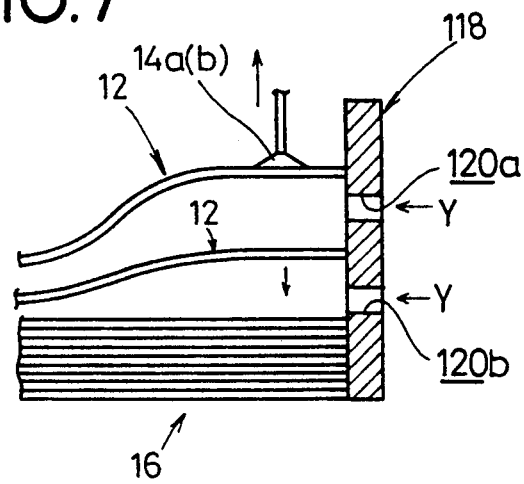
FIG. 7 is a view for describing the operation of the sheet feeding device shown in FIG. 4.

In the second embodiment, the engaging member 118 has a plurality of rows of holes 120*a*, 120*b*, where air is introduced from the holes 120*a*, 120*b* between the uppermost photographic light-sensitive medium 12 and the next photographic light-sensitive medium 12 when the uppermost photographic light-sensitive medium 12 attracted by the suction pads 14*a*, 14*b* is lifted (see FIG. 7). Accordingly, the adhesion of the uppermost photographic light-sensitive medium 12 to the next photographic light-sensitive medium 12 can be effectively prevented. Consequently, the next photographic light-sensitive medium 12 can reliably be separated from the uppermost photographic light-sensitive medium 12, thereby making it possible to prevent a plurality of photographic light-sensitive mediums from being fed simultaneously. This can eliminate the necessity of the so-called swing motion of the photographic light-sensitive medium as required in conventional devices. Thus, the entire construction of the sheet feeding device 100 can be simplified by adopting an extremely-simplified structure in such a way that the holes 120*a*, 120*b* are formed in the engaging member 118.

In the present embodiment, the next photographic light-sensitive medium 12 is separated from the uppermost photographic light-sensitive medium 12 by air which is introduced from the holes 120*a*, 120*b* of the engaging member 118. However, the uppermost photographic light-sensitive medium 12 may be separated from the next and lower photographic light-sensitive mediums 12 by forcibly introducing air from the holes 120*a*, 120*b* into spaces defined among the stacked photographic light-sensitive mediums 12 as indicated by the arrows Y in FIG. 7.

Figure 8:
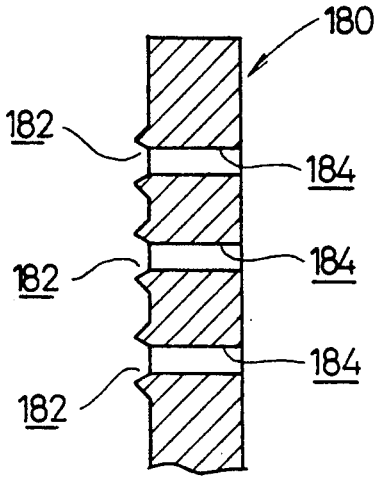
FIG. 8 is a vertical cross-sectional view showing another engaging member employed in the sheet feeding device shown in FIG. 4.

The holes 120*a*, 120*b*, which function as air inlet ports, are formed on a flat side wall of the engaging member 118. However, an engaging member 180 as shown in FIG. 8 may be used to separate more reliably the uppermost photographic light-sensitive medium 12 from the next photographic light-sensitive medium 12.

The engaging member 180 has concave-convex shaped grooves 182 formed on the inner surface of the side wall with which the stacked photographic light-sensitive mediums 12 are brought into contact along with a plurality of holes 184 formed in the side wall of the engaging member 180. Accordingly, air is smoothly introduced from the grooves 182 and the holes 184 of the engaging member 180 into a space between the uppermost photographic light-sensitive medium 12 attracted and lifted upwardly by the suction pads 14*a*, 14*b* as described above and the next photographic light-sensitive mediums 12, thereby making it possible to separate more reliably the adjacent lower photographic light-sensitive medium 12 from the uppermost photographic light-sensitive medium 12.

Further, a plurality of grooves extending in the direction of the stacked photographic light-sensitive mediums 12 (i.e., in the vertical direction in FIG. 7) may be formed in the engaging member 180 so that the grooves can be used as air inlet ports.

A sheet feeding device according to a third embodiment of the present invention will now be described below in detail with reference to the accompanying drawings. The same elements of structure as those employed in the sheet feeding device according to the first embodiment are denoted by the same reference numerals, and will not be described in detail.

Figure 9:
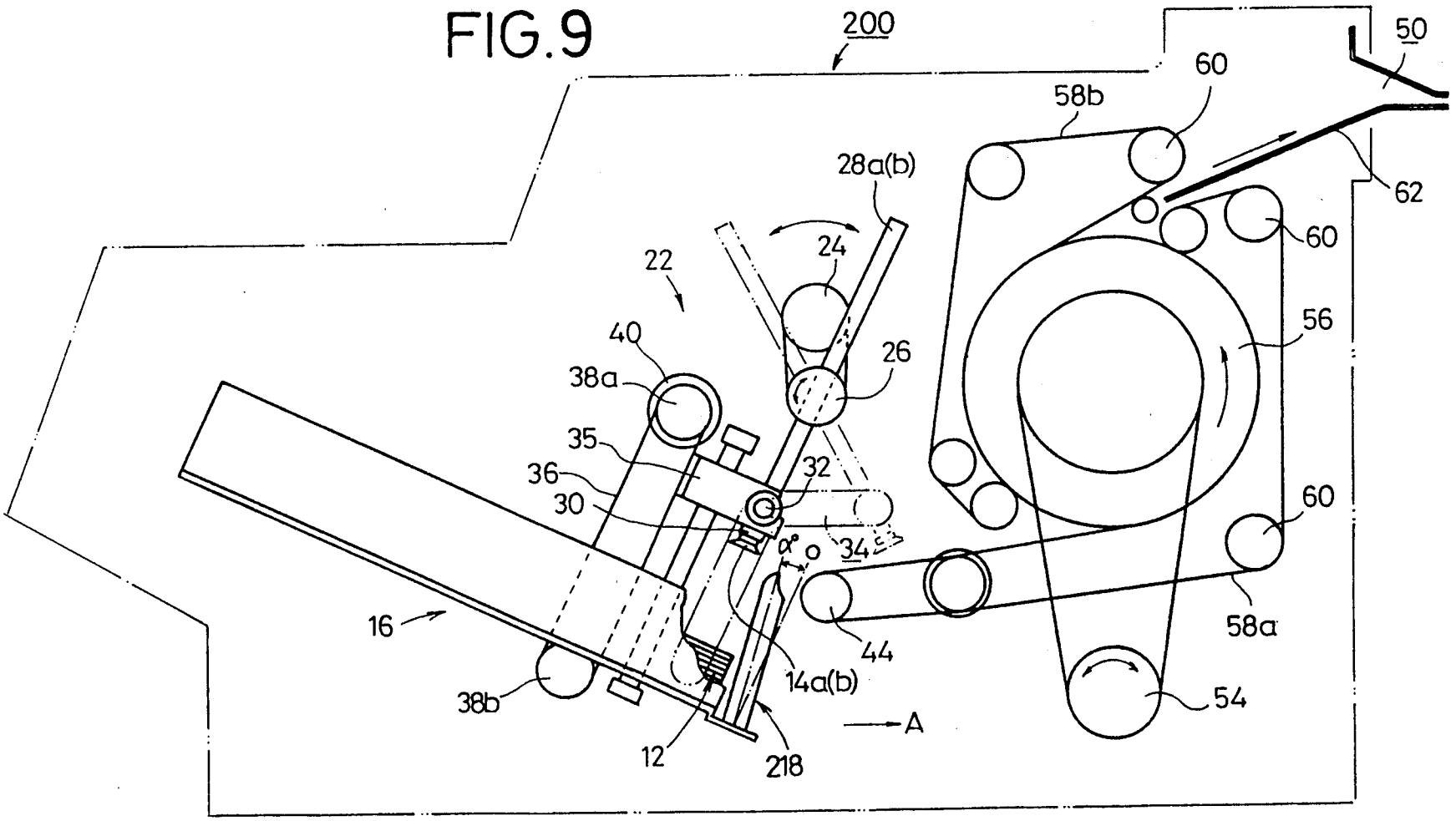
FIG. 9 is a view schematically showing the structure of a sheet feeding device according to a third embodiment of the present invention.
Figure 10:
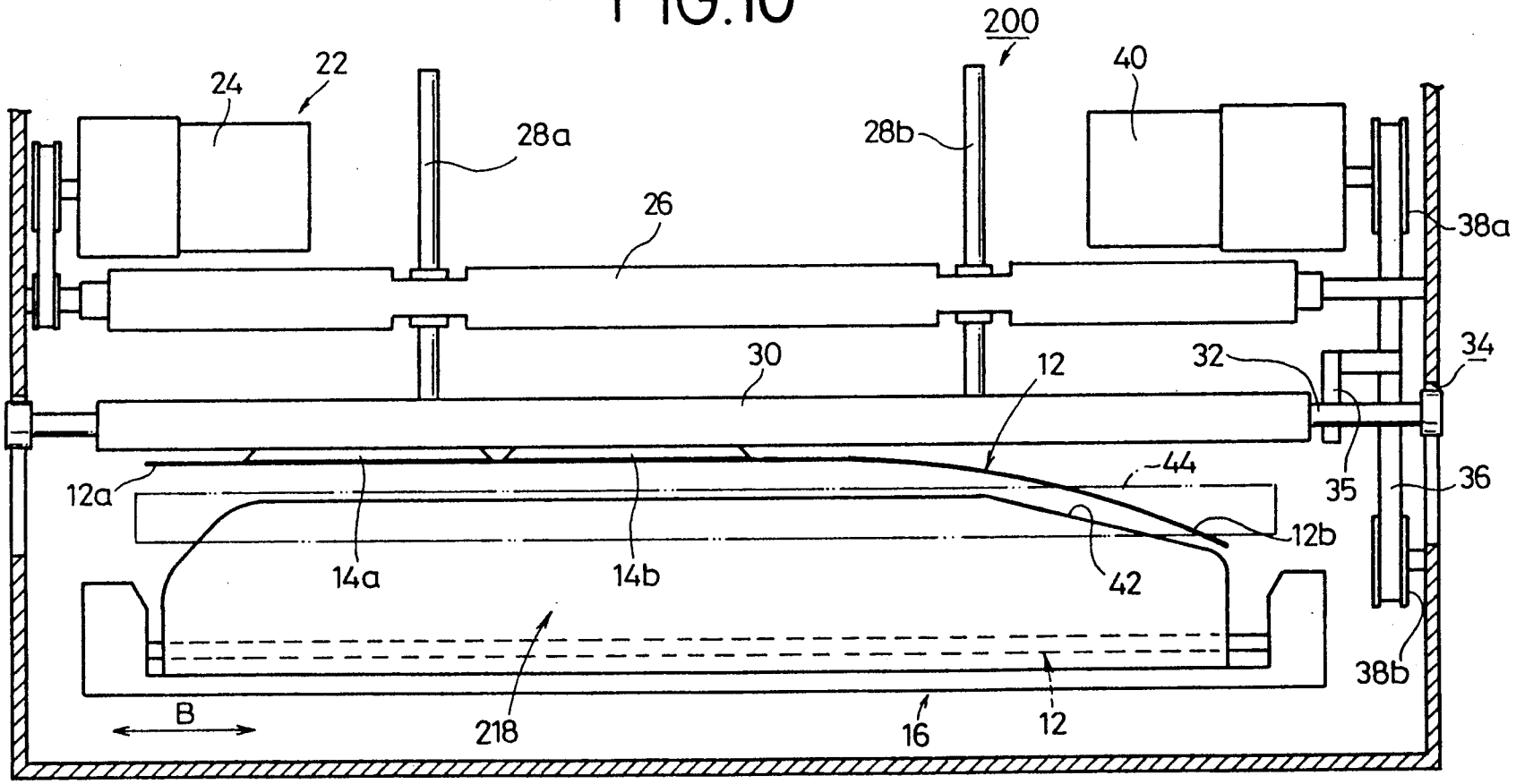
FIG. 10 is a view schematically illustrating the structure of an essential part of the sheet feeding device shown in FIG. 9.

Referring to FIGS. 9 and 10, designated at numeral 200 is the sheet feeding device according to the third embodiment. An engaging member 218 of the sheet feeding device 200 is an elongated plate-like member extending in the direction indicated by the arrow B. In addition, the engaging member 218 has a cut-away portion 42 formed in a portion corresponding to the opposite end 12*b* of the uppermost photographic light-sensitive medium 12, which is spaced away from the suction pads 14*a*, 14*b*. The cut-away portion 42 can prevent the leading end of the uppermost photographic light-sensitive medium 12 from contacting with the engaging member 218 due to a hang down of the photographic light-sensitive medium 12. Specifically, the cut-away portion 42 is formed in such a way that the photographic light-sensitive medium 12 is inclined downwardly toward the opposite end 12*b* from one end 12*a* of the photographic light-sensitive medium 12 as seen in the direction indicated by the arrow B.

Figure 12:
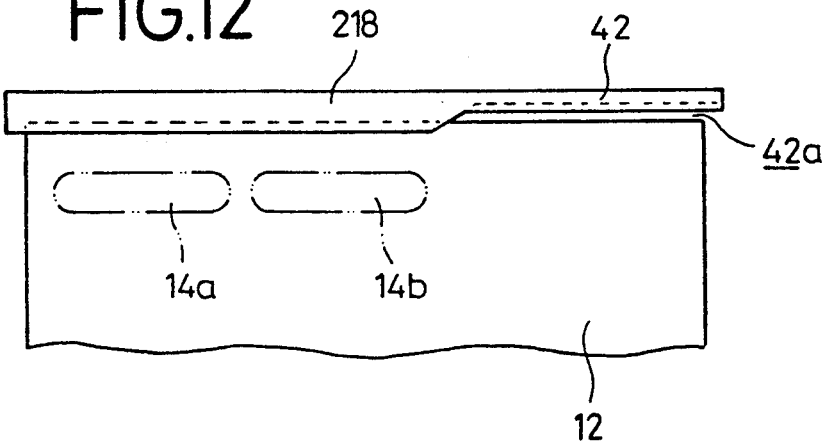
FIG. 12 is a fragmentary plan view showing the sheet feeding device illustrated in FIG. 9.

As shown in FIG. 12, the engaging member 218 has a space 42*a* at one end of the side of the stacked light-sensitive mediums 12 at a position spaced away from the suction pads 14*a*, 14*b*. Thus, any failure in sheet feeding motion, due to contact between a large-sized photographic light-sensitive medium 12 and the engaging member 218, can be prevented.

The engaging member 218 is tilted by a predetermined angle $\alpha°$ toward the stacked photographic light-sensitive mediums 12 from the direction (see the long and short dash line o in FIG. 9) normal to the back surfaces (or front surfaces) of the stacked photographic light-sensitive mediums 12 stored in the sheet placement unit 16. The angle $\alpha°$ may be selected in an angular range of 0.5° or greater, however, the angle $\alpha°$ will preferably be selected from a range of 1° -3° .

The operation of the sheet feeding device 200 constructed as described above w;.11 now be described below. The operation common to that of the aforementioned sheet feeding device 10 will not be described.

Figure 11A:
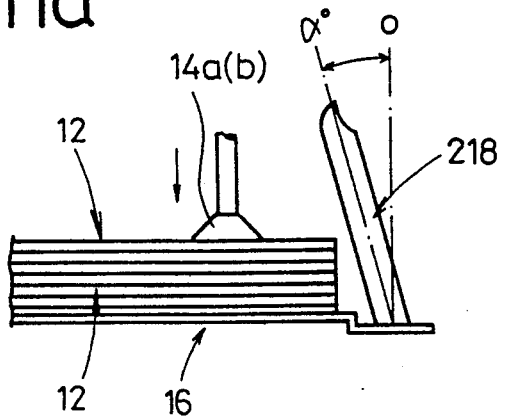
FIG. 11 is a view for describing the operation of the sheet feeding device depicted in FIG. 9.
Figure 11B:
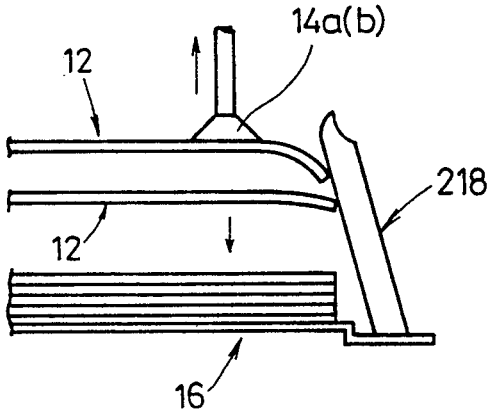

When a plurality of stacked photographic light-sensitive mediums 12 are first loaded in the sheet placement unit 16 in the sheet feeding device 200, the suction pads 14*a*, 14*b* of the drive means 22 attract the uppermost photographic light-sensitive medium 12, (see FIGS. 11*a* and 11*b*).

In the third embodiment, the engaging member 218 for supporting the leading end in the withdrawal direction of the photographic light-sensitive mediums 12 is tilted by the predetermined angle $\alpha°$ toward the photographic light-sensitive mediums 12 from the direction normal to the back surface (or front surface) of photographic light-sensitive mediums 12. Therefore, the leading end of the uppermost photographic light-sensitive medium 12 attracted by the suction pads 14*a*, 14*b* is brought into contact with the engaging member 218 while being moved upwardly, so that its leading end is forcibly flexed (see FIG. 11b). Thus, even if the uppermost photographic light-sensitive medium 12 and the adjacent lower photographic light-sensitive mediums 12 adhere firmly, the adjacent lower photographic light-sensitive mediums 12 can reliably be separated from the uppermost photographic light-sensitive medium 12, thereby making it possible to prevent a plurality of photographic light-sensitive mediums from being fed, simultaneously. This can eliminate the so-called swing motion of photographic light-sensitive medium as preferred as in conventional device. The entire construction of the sheet feeding device 200 can also be simplified, by adopting an extremely-simplified structure in such a way that the engaging member 218 is tilted by a predetermined angle.

Since the lower end of the engaging member 218 is spaced away from the stacked photographic light-sensitive mediums 12, the next and lower photographic light-sensitive mediums 12 thus separated can reliably be returned in the sheet placement unit 16 without interfering with the engaging member 218. It is thus possible to eliminate an unnecessary process for returning unwanted photographic light sensitive mediums to a sheet placement unit by using a pressing bar as in the conventional method. In addition damage of the lower photographic light-sensitive mediums caused by lowering suction pads when the lower photographic light-sensitive mediums are caught by the engaging member 218 can be prevented so that the photographic light-sensitive mediums are efficiently and smoothly separated and fed.

As has been described above, the sheet feeding device according to the present invention can bring about the following advantageous effects. In the present invention, a sheet separating means is activated to attract and hold one end of the edge of the uppermost sheet, to remove the uppermost sheet from a sheet placement unit in a state in which the leading end in the withdrawal direction of each of stacked sheets is being supported by an engaging member. The end of the sheet opposite from the separating means tends to hang down due to the weight of the sheet give that the opposite end of a sheet is spaced away from the sheet separating means. However, since a cut-away portion facing the opposite end of the sheet is formed at the engaging member, contact between the opposite end of the sheet and the engaging member is reliably prevented. Accordingly, sheets of different sizes can reliably and efficiently be fed one by one with a simple construction, and the sheets can be handled with great ease.

According to the sheet feeding device of the present invention, so as to upwardly remove the sheet from the sheet placement unit 16 when a sheet separating means is operated to remove the uppermost sheet from a sheet placement portion in a state in which the leading end in the withdrawal direction of stacked sheets is supported by an engaging member, where air is introduced from air inlet ports into a space between the uppermost sheet and the lower adjacent sheet, thereby making it possible to reliably and easily separate the lower adjacent sheets from the uppermost sheet. It is therefore unnecessary to use a sheet feeding device having a complex structure for swinging the uppermost sheet, thereby making it possible to simplify the entire structure of the sheet feeding device another advantageous effect results.

According to the sheet feeding device, when a sheet separating means is used to remove the uppermost sheet from a sheet placement portion in a state in which the leading end in the withdrawal direction of the stacked sheets is supported by an engaging member, where the leading end of the uppermost sheet attracted by the sheet separating means is brought into contact with the engaging member to be forcibly flexed because the engaging member is tilted by a given angle. Specifically, the engaging member is tilted toward the stacked sheets from the direction normal to the upper surface of the stack, so that the uppermost sheet can be reliably and easily separated from the lower adjacent sheets. It is therefore unnecessary to employ a sheet feeding device having a complex structure for swinging the uppermost sheet thereby making it possible to simplify the entire structure of the sheet feeding device. Further, since the lower end of the engaging member is spaced away from the stacked sheets, the lower sheets thus separated can reliably be returned to the sheet placement portion without restraining the sheets from moving toward the sheet placement portion thereby making it possible to efficiently and easily feed the stacked sheets one by one.

Having now fully described the invention, it will be apparent to those skilled in the art that many changes and modifications can be made without departing from the spirit or scope of the invention as set forth herein.

What is claimed is:

1. A device for feeding sheets one by one, said device comprising:

sheet separating means for removing an uppermost sheet from a plurality of stacked sheets; and engaging means located at a sheet placement portion for limiting the leading ends of said plurality of stacked sheets from moving in a withdrawal direction of said plurality of stacked sheets, wherein said engaging means having at least one air inlet port for introducing air into a space between the uppermost sheet and an adjacent sheet when the uppermost sheet is removed from the stacked sheets to enable the adjacent sheet to be separated from the uppermost sheet, and said one air inlet port comprises a hole through which air is forcibly introduced, said hole being surrounded by a concave-convex protrusion which aids in the introduction of air into said space between said uppermost sheet and said adjacent sheet.

2. A device for feeding sheets one by one, comprising:

sheet separating means for removing an uppermost sheet from a plurality of stacked sheets; and engaging means located at a sheet placement portion for limiting the leading ends of the plurality of sheets from moving in a withdrawal direction of said plurality of stacked sheets, wherein, said engaging means has at least one air inlet port for introducing air into a space between the uppermost sheet and an adjacent sheet when the uppermost sheet is removed from the plurality of stacked sheets to enable the adjacent sheet to be separated from the uppermost sheet, said engaging means further includes a recess formed on a portion of said engaging means facing a first end of the uppermost sheet, said first end of the uppermost sheet being opposite a second end of the uppermost sheet, where a top face of the second end of the uppermost sheet is engaged by said sheet separating means, and said recess portion is formed on said portion of said engaging means in a widthwise direction of said engaging means so as to produce a space between said first end of the uppermost sheet and the engaging means to prevent said first end from contacting said engagement means due to a hang down of the uppermost sheet.

3. A device for feeding sheets one by one, said device comprising:

sheet separating means for removing an uppermost sheet from a plurality of stacked sheets; and engaging means located at a sheet placement portion for limiting the leading ends of said plurality of stacked sheets from moving in a withdrawal direction of said plurality of stacked sheets, said engaging means having at least one air inlet port for introducing air into a space between the uppermost sheet and an adjacent sheet when the uppermost sheet is removed from the stacked sheets to enable the adjacent sheet to be separated from the uppermost sheet, wherein said engaging means includes a cut-away portion located on said engaging means at a portion facing an end of an edge of the uppermost sheet, said end of the uppermost sheet is spaced away from said sheet separating mans, and said cut-away portion is formed to prevent said end of the uppermost sheet from contacting said engaging means due to a hang down of the uppermost sheet.

* * * * *